US011235347B2

(12) United States Patent
Horn

(10) Patent No.: US 11,235,347 B2
(45) Date of Patent: Feb. 1, 2022

(54) SYSTEM AND METHOD FOR COATING TUBES

(71) Applicant: PLASTOCOR, INC., Hingham, MA (US)

(72) Inventor: Michael J. Horn, Dedham, MA (US)

(73) Assignee: PLASTOCOR, INC., Hingham, MA (US)

( * ) Notice: Subject to any disclaimer, the term of this patent is extended or adjusted under 35 U.S.C. 154(b) by 26 days.

(21) Appl. No.: 15/205,506

(22) Filed: Jul. 8, 2016

(65) Prior Publication Data

US 2017/0008027 A1 Jan. 12, 2017

Related U.S. Application Data

(60) Provisional application No. 62/190,938, filed on Jul. 10, 2015.

(51) Int. Cl.

| | |
|---|---|
| ***B05C 7/08*** | (2006.01) |
| ***B05D 1/42*** | (2006.01) |
| ***B05D 7/22*** | (2006.01) |
| *B05D 7/00* | (2006.01) |

(52) U.S. Cl.

CPC ..... *B05C 7/08* (2013.01); *B05D 1/42* (2013.01); *B05D 7/222* (2013.01); *B05D 7/52* (2013.01)

(58) Field of Classification Search

CPC .. B05D 1/42; B05D 7/222; B05C 7/00; B05C 7/04; B05C 7/06; B05C 7/08; B05C 11/021; B08B 9/0557; B08B 9/0553; B08B 9/053

See application file for complete search history.

(56) References Cited

U.S. PATENT DOCUMENTS

| | | | |
|---|---|---|---|
| 2,188,959 | A | 2/1940 | Schaer |
| 3,056,156 | A | 10/1962 | Immel |
| 3,543,323 | A | 12/1970 | Girard |
| 3,598,636 | A | 8/1971 | Honeycutt, Jr. |
| 4,069,535 | A | 1/1978 | Cato |
| 4,335,677 | A | 6/1982 | Nagata et al. |
| 4,368,219 | A | 1/1983 | Nagata et al. |

(Continued)

FOREIGN PATENT DOCUMENTS

| | | |
|---|---|---|
| EP | 0581616 A1 | 2/1994 |
| EP | 0713048 A1 | 5/1996 |

(Continued)

OTHER PUBLICATIONS

Horn, Michael J., et al "Condenser Tube Coating as a Means of Life Extension and Performance Enhancement," 1996 EPRI Condenser Technology Conference.

*Primary Examiner* — Michael P. Rodriguez
(74) *Attorney, Agent, or Firm* — Grogan, Tuccillo & Vanderleeden, LLP

(57) ABSTRACT

The present invention relates to coating of tubes, and more particularly to a system and method for coating and/or renovating deteriorated or pitted tubes to extend tube life and enhance performance. Using this system and method a thin coating is applied to the interior of a tube such that the coating is uniform in thickness and covers all regions of the tube. The coating material may be selected to minimize changes in heat transfer or may be selected to provide for the change in working fluid within the tube such that the working fluid does not negatively interact with the tube material.

9 Claims, 4 Drawing Sheets

(56) References Cited

U.S. PATENT DOCUMENTS

| | | | | |
|---|---|---|---|---|
| 4,413,370 | A | 11/1983 | Payne et al. | |
| 4,421,790 | A | 12/1983 | Nagata et al. | |
| 4,425,385 | A | 1/1984 | Coulter et al. | |
| 4,427,034 | A | 1/1984 | Nagata et al. | |
| 4,475,629 | A | 10/1984 | Jonnes | |
| 4,548,258 | A | 10/1985 | Nelson et al. | |
| 4,774,905 | A | 10/1988 | Nobis | |
| 4,774,938 | A | 10/1988 | Leight | |
| 5,150,493 | A * | 9/1992 | Sivacoe | B08B 9/0554 15/104.061 |
| 5,230,842 | A | 7/1993 | Munde | |
| 5,265,302 | A * | 11/1993 | Sivacoe | B08B 9/0554 15/104.061 |
| 5,326,400 | A | 7/1994 | Sagawa | |
| 5,457,841 | A * | 10/1995 | Minton | B08B 9/0557 15/104.061 |
| 5,544,698 | A | 8/1996 | Paulman | |
| 5,625,917 | A | 5/1997 | Hawkins | |
| 5,709,503 | A | 1/1998 | Manlow | |
| 5,879,456 | A | 3/1999 | Curran | |
| 5,911,828 | A | 6/1999 | Curran | |
| 5,924,913 | A | 6/1999 | Reimelt | |
| 6,117,242 | A | 9/2000 | Kreiselmaier | |
| 6,145,150 | A | 11/2000 | Knapp | |
| 6,263,534 | B1 | 7/2001 | McCann et al. | |
| 6,574,821 | B1 * | 6/2003 | Dal Maso | B08B 9/0557 15/104.061 |
| 6,613,261 | B2 * | 9/2003 | Knapp | B08B 9/0557 264/250 |
| 6,739,950 | B1 | 5/2004 | Kruse | |
| 6,755,916 | B1 | 6/2004 | Pruett | |
| 7,270,847 | B2 | 9/2007 | Horn | |
| 7,717,056 | B2 | 5/2010 | Horn | |
| 8,359,996 | B2 | 1/2013 | Horn | |
| 8,833,293 | B2 | 9/2014 | Horn | |
| 2003/0056309 | A1 * | 3/2003 | Savard | B08B 9/0551 15/104.061 |
| 2010/0162503 | A1 * | 7/2010 | Rosen | B08B 9/035 15/104.061 |
| 2010/0180391 | A1 * | 7/2010 | Pruett | B08B 9/053 15/104.061 |
| 2012/0017386 | A1 * | 1/2012 | Rankin | B08B 9/0557 15/104.061 |

FOREIGN PATENT DOCUMENTS

| | | | |
|---|---|---|---|
| EP | 0793050 | A2 | 9/1997 |
| FR | 2728652 | A1 | 6/1996 |
| JP | 62191077 | | 8/1987 |
| JP | 04092187 | | 3/1992 |
| JP | 09201560 | A | 8/1997 |
| JP | 2001191045 | A | 7/2001 |
| JP | 2003284989 | A | 10/2003 |
| SU | 1648872 | A1 | 5/1991 |
| WO | 2006009815 | A2 | 1/2006 |
| WO | 2006009926 | A2 | 1/2006 |

* cited by examiner

SYSTEM AND METHOD FOR COATING TUBES

CROSS-REFERENCE TO RELATED APPLICATIONS

This application claims the benefit of U.S. Provisional Application Ser. No. 62/190,938, filed on Jul. 10, 2015, which is herein incorporated by reference in its entirety.

FIELD OF THE INVENTION

The present invention relates to coating of tubes, and more particularly to a system and method for coating and/or renovating deteriorated or pitted tubes to extend tube life and enhance performance.

BACKGROUND OF THE INVENTION

Metal tubes have many different applications across a broad spectrum of industrial uses. One example use of metal tubes is in heat exchanger configurations. Fluids or gases running through and over the tubes in the heat exchanger provide heating or cooling as desired. One such heat exchanger application is in the form of a condenser. A condenser is generally utilized to cool steam as it passes over the heat exchanger tubes, which have cooling water passing therethrough. Corrosion, deterioration, erosion, pitting, and fouling of condenser tubes can play a major role in the effectiveness of the heat exchanger apparatus. In addition, maintenance costs, water, chemistry, replacement costs, and down time for repair, are other issues that relate to the performance of the tubes in the condenser or heat exchanger.

The purpose of the tubes in heat exchanger configuration is to provide a barrier between the cooling media (in the form of water, most often) and the heated fluid, and to facilitate heat transfer. Over the course of time, the inner surfaces of the tubes can pit or erode, and eventually may begin to leak and cease to be an effective barrier.

In an effort to prevent or delay the formation of pits or erosion within the tubes, epoxy coatings and other rebuilding compounds have been used. In particular, coatings have been used to protect tube interiors of copper based alloys at the inlet end where water turbulence in conjunction with entrained solids can cause accelerated erosion damage. Coatings extending three inches to twenty-four inches into the tube have been successful in preventing degradation in this area.

In addition, more recent approaches have involved coating the entire length of the tubes. Since coatings often significantly reduce fouling and corrosion of the inner surfaces of the tubes, long term performance of coated tubes can ultimately be better than uncoated tubes. One potential side effect associated with the use of coatings is the extent to which heat transfer varies with different characteristics relating to the coatings. Various factors will affect how a coating affects heat transfer, such as but not limited to thermal conductivity of the coating, interface effects between coating and tube, interface effects between multiple coatings, laminar flow effects, fouling effects and applied thickness. The thermal conductivity of the coating is a factor of the resin and filler blend in addition to how well integrated the resin and filler blend are to the other. Interface effects are a function of coating wettability and application parameters, such as temperature, humidity, dust control, and number of coats. In addition, the applied thickness of the coating varies with the number of coats. More specifically, conventionally two coats have been applied to the interior portions of the tubes, however, one coat is preferable because of the reduced thickness and reduced material costs. A full length tube coating currently is typically applied using a spraying process resulting in a coating thickness on the order of 2 mils to 5 mils. Such a thickness can penalize heat transfer capabilities, reducing them in the range of 15%-38% before fouling factors are considered.

Once tubes are placed into service in a heat exchanger they develop protective oxide layers and begin to foul. If the fouling rate is rapid, then tube performance can degrade quickly. Depending on the design cleanliness assumptions and available capacity of tubes, such degradation of performance is tolerable to a certain extent until such time as the heat exchanger must be cleaned or the tubes ultimately replaced. Coatings can prevent formation of oxides and also reduce the rate at which fouling occurs.

A significant concern relating to the degradation of heat transfer characteristics and overall performance of heat transfer tubes relates to the effect of pin holes or pitting due to corrosion of the inner surface of the tube. Currently, common materials utilized for tubes include copper alloys, stainless steel alloys, and titanium alloys, and carbon steel. These tubes work by forming passive films in their intended service. When the passive film breaks down, corrosion occurs. Coatings placed on the inner surface of the tubes can obviate the need for a passivation layer to form.

SUMMARY OF THE INVENTION

There is a need for an improved system and method relating to the application of a coating to the inner surface of tubes to both provide a protective coating and repair or renovate corroded or pitted inner tube surfaces. The present invention is directed toward further solutions to address this need.

In accordance with one aspect of the present invention, a pig device for use in the application of a coating material to a tube includes an elongated body portion having a front end and a rear end and a plurality of spaced annular flexible ribs circumscribing said body portion and extending radially outward from said body portion for contacting the inside wall of the tube. Each of said ribs is generally sprocket shaped and has a plurality of teeth angularly spaced from one another and defining a plurality of grooves therebetween allowing for a passage of the coating material past the ribs.

In accordance with one embodiment of the present invention, a method of coating an inner surface of a tube includes providing coating material in the tube. A pig device is provided in the tube, positioned to push the coating material through the tube. The pig device is propelled through the tube to apply the coating material to form a coating.

In accordance with one embodiment of the present invention, a system, method and device for coating an inner surface of a tube is provided wherein a pig device is motivated along the length of the tube using a propulsion mechanism. This propulsion mechanism may take numerous forms, including a pressure differential or a mechanical means. Following propulsion of this pig device through the tube a coating is thereby provided along the inner surface of the tube. This applied coating may be of uniform thickness and may have a minimal effect on the heat transfer characteristics of the tube. This applied coating may fill eroded elements in the tube, renovate regions of the tube which have deteriorated, span and bridge cracks in the tube or may serve to provide a uniform coating along the interior surfaces of the tube wherein the tube material is encapsulated.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION

Figure 1:
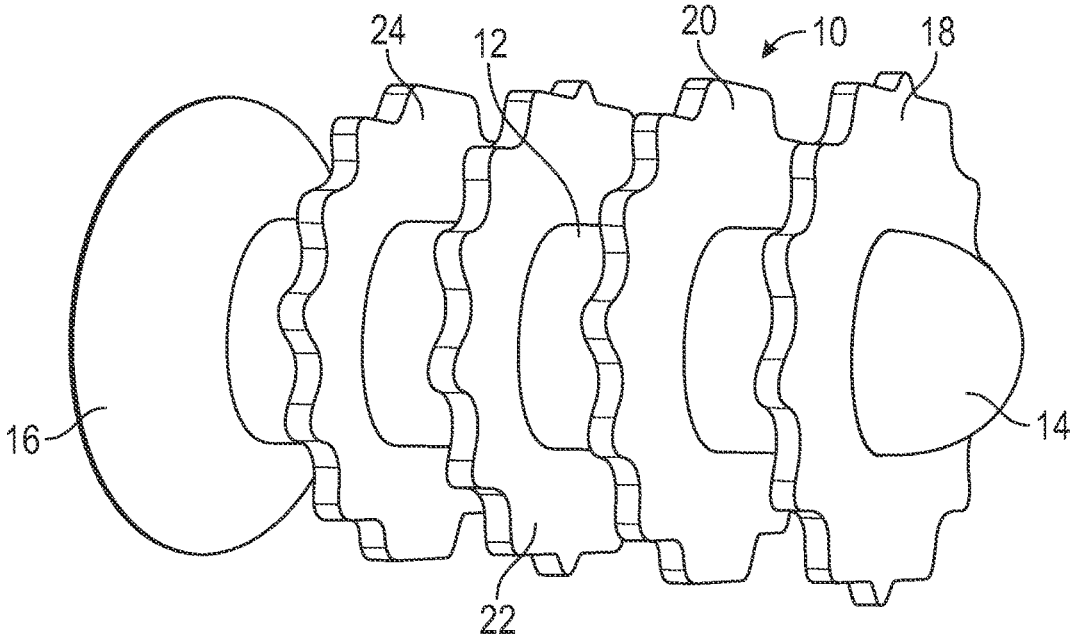
FIG. 1 is a side, perspective view of a pig device in accordance with an embodiment of the present invention.

An illustrative embodiment of the present invention relates to a system and method for coating and/or renovating the inner surface of a pipe or tube, such as a heat exchanger tube. The system and method involve providing a pig device configured to be inserted into the tube with a selected quantity of coating material. The pig device is pushed through the tube with compressed air. While the pig device travels along the inner surface of the tube, the pig device transports the coating material and applies the coating material to the inner surface of the tube to form a coating. If there are pits or other deterioration or erosion elements on the inner surface of the tube, the coating fills in such elements to repair or renovate the tube surface. The pig device can be used in on-site applications where the heat exchanger tubes are in their installed configuration. Alternatively, the tubes can be coated using the same device and process in a manufacturing setting where the tubes are being fabricated for eventual installation into a heat exchanger, or for some other application requiring a coated tube.

FIGS. 1 through 6, wherein like parts are designated by like reference numerals throughout, illustrate an example embodiment of a system and method for applying coatings and/or repairing inner surfaces of tubes according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

Pigging technology falls under the genres of fluid mechanics, pipeline technology, and chemical engineering. A general definition of pigging is the propulsion through a pipe of a mobile plug pig which can execute certain activities inside the pipe or tube. Pigging can be used, for example, to clean a pipe mechanically using brushes, or to check the interior condition of the pipe or tube using a video camera. In pigging, the contents of a pipeline are pushed by a snug-fitting plug, known as the pig, with the goal of removing the contents almost completely from the pipeline. The pig is propelled through the pipe by a gas or a liquid propellant. The pig can be spherical, elongated, or composed of several parts. The pig is oversized relative to the pipe; thus, the pipe is sealed in front of and behind the pig. This enables the pig to be driven through the pipe by the gas or liquid propellant. The gas most frequently used is compressed air, and the liquid can be water or a cleaning agent or product.

It should be noted that the following description uses a heat exchanger as an example configuration for tubes that may require the functionality of the present invention. However, one of ordinary skill in the art will appreciate that heat exchanger tubes are merely one example application of tube structures having fluids flowing therethrough that may require a coating or a repair of the inner tube surface. Accordingly, the present invention is not limited to use with heat exchanger tubes, but can be used on a number of different types of tubes in a number of different configurations and having a number of different functions. The end result of the implantation of the present invention is that of a coated and/or repaired or renovated inner tube surface. As such, the invention is anticipated to be utilized in any application that may require such services.

Figure 2:
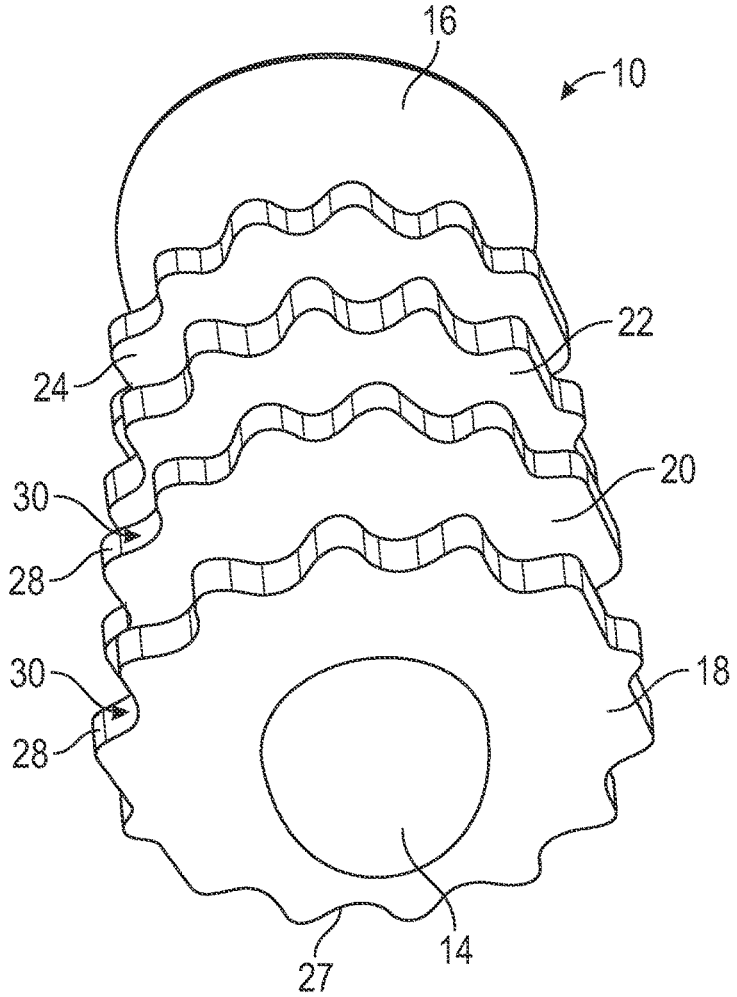
FIG. 2 is a front, perspective view of the pig device of FIG. 1.
Figure 3:
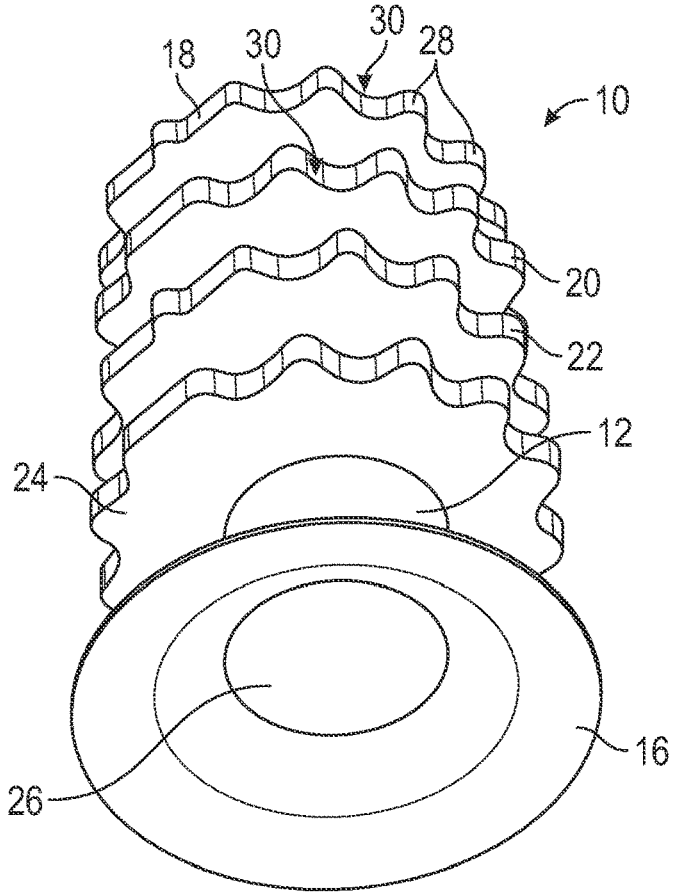
FIG. 3 is rear, perspective view of the pig device of FIG. 1.

FIGS. 1-3 are perspective illustrations of a pig device 10 in accordance with one embodiment of the present invention. The pig device 10 has an elongated, cylindrical stem or body portion 12 having a front end or nose 14 and a flanged end 16 opposite the nose 14. The stem 12 is generally cylindrical in shape, however, one of ordinary skill in the art will appreciate that the cylindrical shape with circular cross-section can vary with the particular application, such that square, oblong, or other cross-sections can be embodied by the present invention. The present invention is thus not limited to the generally cylindrical shape.

Figure 4:
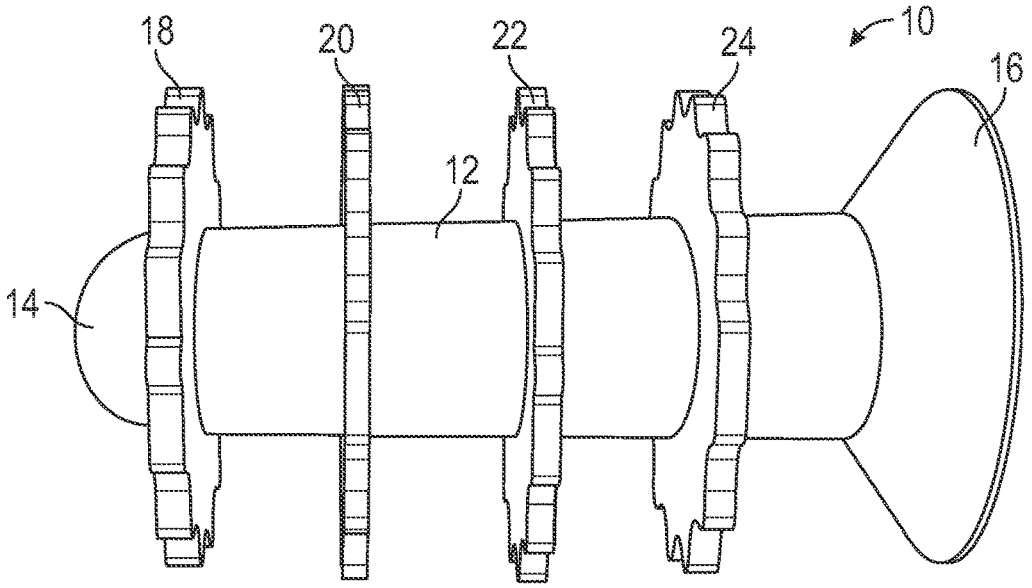
FIG. 4 is a side elevational view of the pig device of FIG. 1.
Figure 5:
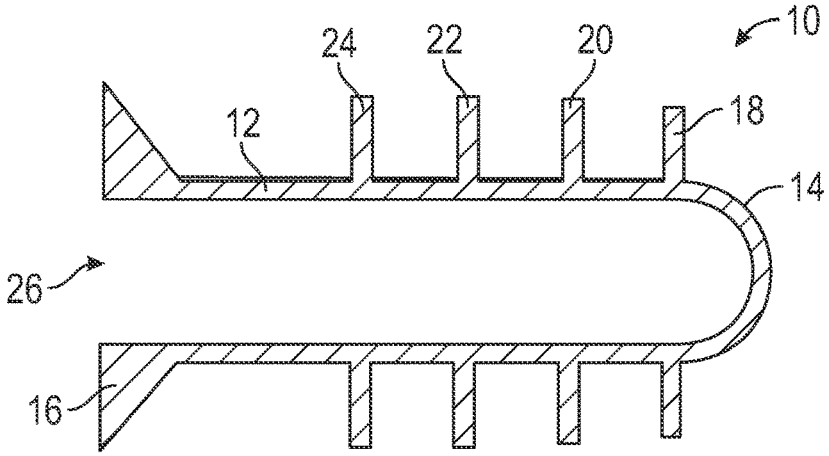
FIG. 5 is a cross-sectional, side view of the pig device of FIG. 1.

As best illustrated in FIG. 4, the flanged end 16 increases the diameter dimension of the pig device 10 at the tip of the flange to perform a wiping function as later described herein. An elongated central aperture 26 is formed in the stem 12 that extends from the flanged end 16 to the nose 14. The nose 14, similarly, has a small aperture 27 formed therein which to allow the pig device 10 to be pulled through a tube, as discussed hereinafter. The pig device 10 also includes a plurality of spaced annular, flexible fins or ribs, including ribs 18, 20, 22 and 24, that circumscribe the stem 12 and extend radially outward from the stem 12.

With further reference to FIGS. 1-4, the flexible ribs 18, 20, 22 and 24 are generally sprocket shaped, having a plurality of teeth 28 and alternating grooves 30 formed around the circumference of each rib. In a preferred embodiment, the teeth 28 on each rib are angularly spaced from adjacent teeth an equal extent, as discussed in detail below. Moreover, such angular spacing between adjacent teeth is substantially consistent among all of the ribs 18, 20, 22 and 24. Importantly, however, the angular positions of the teeth 28 on the leading rib 18 and the third rib 22 are offset such that the teeth 28 on ribs 18, 22 are aligned in the longitudinal or axial direction with the grooves 30 in the second rib 20 and trailing rib 24.

Figure 6A:
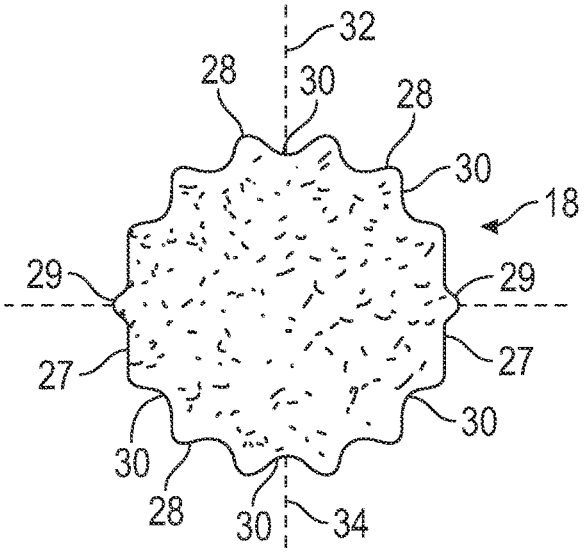
FIGS. 6A and 6B are cross-sectional, end views of two ribs of the pig device of FIG. 1.
Figure 6B:
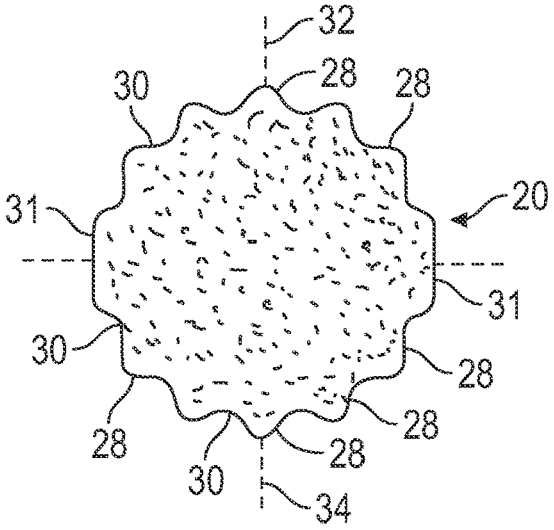

This orientation is more specifically shown in FIGS. 6A and 6B, which depict cross-sectioned ribs. While the cross-sectioned ribs are shown as solid, they may have a hollow or void in an interior rib surface, depending upon whether the pig device has a hollow interior. As shown, the leading rib 18 (FIG. 6A) has a groove 30 in the twelve o'clock position 32 and the six o'clock position 34. The third rib 22 is substantially identically oriented. The second rib 20 (FIG. 6B), and the trailing rib 24, however, have a tooth 28 in the twelve o'clock position 32 and the six o-clock position 34. More specifically, the positions of the teeth 28 on the first and third ribs 18, 22 are angularly offset relative to the positions of the teeth 28 on the second and fourth ribs 20, 24 a distance equal to one half of the pitch. As used herein, pitch refers to the arc distance between the points of adjacent teeth 28. In this respect, the teeth 28 in each rib 18, 20, 22, 24 are longitudinally aligned with the grooves 30 in the rib immediately preceding it and following it. This orientation is particularly effective at creating turbulence.

As illustrated in FIGS. 6A and 6B, in an embodiment, the teeth 28 of at least one of the ribs, and preferably each of the ribs, have a thickness that decreases in a direction moving from a dedendum circle of the rib to an addendum circle of said rib. This configuration is most clearly illustrated in FIGS. 6A and 6B. In particular, as shown therein, teeth 28 are come to a point or apex at the addendum circle/outer circumference of the ribs.

As shown, in certain embodiments, the ribs also include portions that include one or more substantially flat surfaces 27, 31. These can be located at the three o'clock and 9 o'clock positions on each rib. In certain embodiments, the flat surfaces can include a tooth 29 (FIG. 6A).

As will be appreciated, the pig device 10 can be made of a number of different materials, including but not limited to plastic, composite, metal, polymer materials, combinations thereof, and the like. Importantly, however the flange 16 and the ribs 18, 20, 22 and 24 are flexible. Likewise the number of teeth may vary to an extent as long as the orientation described above is substantially maintained and effectively creates turbulence.

Figure 7:
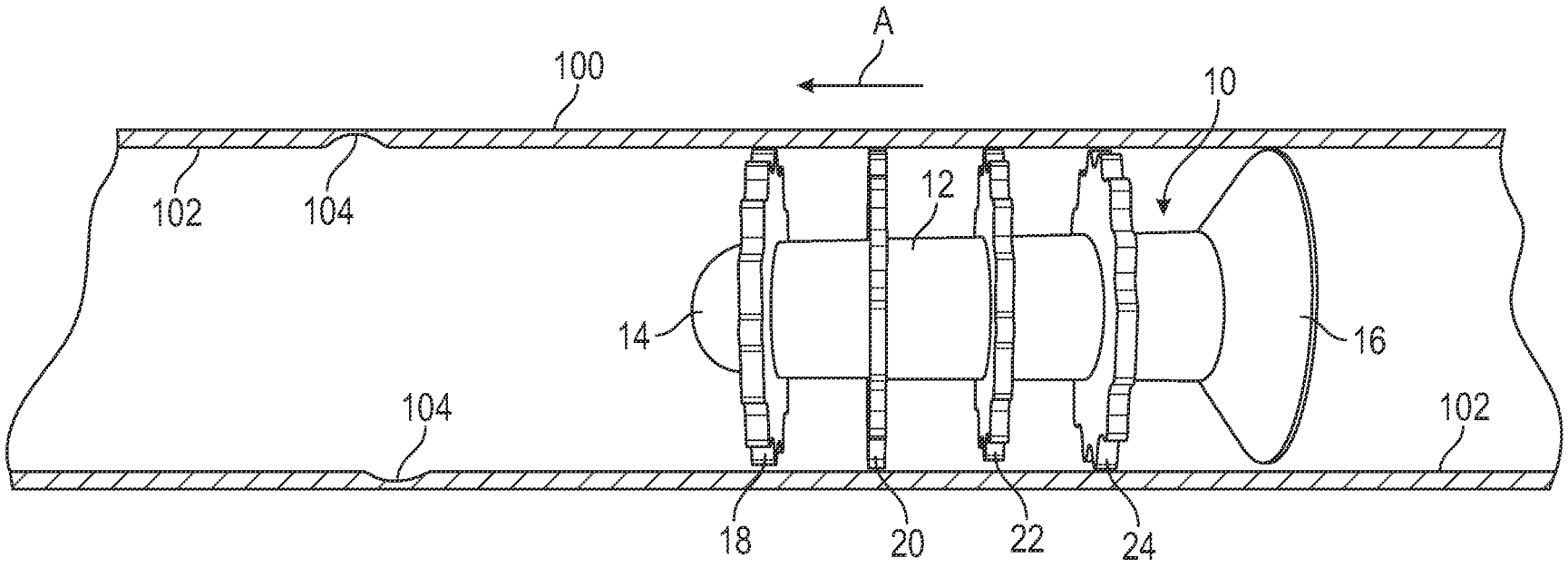
FIG. 7 is a diagrammatic illustration of the pig device in use in a tube, according to an embodiment of the present invention.

FIG. 7 is a diagrammatic illustration of the pig device 10 illustrated previously in FIGS. 1-6 following insertion into a tube 100 or pipe to apply a coating. The tube 100 can be made of a number of different materials, such as metal, plastic, composite, ceramic, alloy, and the like. However, in the case of heat exchanger tubes, the most common material currently utilized is copper alloy, stainless steel, or titanium alloys. The tube 100 has an inner surface 102 formed by the walls of the tube 100. In the example illustrated, the tube 100 includes erosion elements 104 (e.g., pitting, deterioration, erosion, corrosion, pin holes, and the like). The erosion elements 104 are representative of the types of defects that can occur in a heat exchanger, or other tube, over time. The erosion elements 104, as described above, can detract from the efficiency and effectiveness of heat transfer by the tube 100, and can eventually lead to leak formation and cross-contamination of fluids (from inside the heat exchanger and outside the heat exchanger). Accordingly, there is often a desire to repair such an erosion element 104, or ultimately replace any tubes containing such erosion elements 104, to maintain tube performance.

The point of the teeth 28 of the pig device 10 provide centering and stabilizing functionality as it travels through a pipe (not shown). Each of the ribs 18, 20, 22 and 24, as well as the flange 16, are sized and dimensioned to approximate an effective diameter of the pig 10 of slightly less than the inner diameter of the tube within which the pig 10 device is intended to be used. In an embodiment, the pig device 10 is approximately 1.7 inches to 2.0 inches in length, from the end of the flange 16 to the tip of the nose 14. The sizing of the ribs and the end flange is such that the pig device 10 can slide through the tube 100 without being frictionally wedged inside the tube 100. Likewise, the effective diameter of the ribs and the end flange must be large enough to provide stability and prevent the pig device 10 from tumbling within the tube 100.

In operation, prior to inserting the pig device 10 into the tube 100, a selected quantity of coating material (not shown) is placed in the tube 100. Alternatively, the coating material can be placed on the forward end of the pig device 10. The amount of coating material provided depends upon a number of factors, including the length of tube 100 to be coated, the thickness of the coating, the specific configuration of the pig device 10 being utilized to spread the coating material, the environment (such as humidity and temperature), the type of coating material and associated coating properties (such as viscosity), and the like. Example materials forming the coating material include but are not limited to epoxies, phenolics, vinal esters, poly esters, urethanes, other polymers, and other coating materials. The specific type of coating material utilized will depend largely on the purpose of the coating and the environment in which it is applied and to be maintained, as understood by one of ordinary skill in the art. For example, the coating material may contain numerous additives to improve performance of the tube or reduce further problems. A non-exhaustive list of suitable additives includes waxes, silicones, and other dry lubricants such as molybdenum disulfide.

Furthermore, to combat the growth of biological organisms along the inner surface of the tube, various algicides, biocides and fungicides can be added to the coating which kill or deter the growth of these organisms. Growth of biological organisms such as algae, fungi, bacterial and other micro organisms along the inner surface of the tube may result in fouling of the tube surface as well as the creation of obstructions within the tube. Fouling and obstructions such as this can reduce heat transfer within the tube as well as restrict or prohibit fluid flow. Furthermore, the existence of biological growth can further induce various types of corrosion along the tube wall, thereby resulting in deterioration and eventual tube failure. The introduction of algicides, biocides and fungicides into the coating material thereby serves to prevent or minimize such problems. Suitable substances for curbing biological growth include, but are not limited to ortho-phenylphenol (OPPS); isothiazolinone derivatives (such as 2-n-octyl-4-isothiaszolin-3-1 (OTT); guanides and biguanides; carbamates and dithiocarbamates; copper, sodium or zinc pyrithione; benzimidazoles; n-haloalkylthio compounds; 1-(3-chloroallyl)-3,5,7-tri-aza-1-azionia-adamantanechloride; tetrachloroisophthalonitriles; cis[1-(3-chloroallyl)-3,5,7-tri-aza-1-azonia-adamantane] chloride and 2,2-dibromo-3-nitropropionamide (DBNPA); and quaternary ammonium compounds.

Additionally, the coating materials of the present invention may be of varying viscosity. Unlike traditional coating methods, wherein the coating material is sufficiently thinned using a solvent, the coating of the present invention may be used in an un-thinned high viscosity state. The use of a thinning solvent aids in the flow of existing coating throughout the tube and helps control cure time properties. Following the coating of tube with a thinned coating, one must await the evaporation of the solvent from the coating material for the coating to cure. As heat exchanger tubing has a very low diameter to length ratio to maximize surface area for heat transfer, this confined space oftentimes makes it difficult for a solvent to migrate. Further compounding this difficulty are any pits in the tube wall which may be filled with the solvented coating, whereby the likelihood that some solvent may be trapped in these pits is greatly increased.

In contrast, as the coating in the present invention is pushed through the tube, coating with higher initial viscosities can be used in an un-thinned state. For example, coatings with viscosities of 100,000 cps or greater can be readily used. In light of this, the risks associated with incomplete solvent removal are eliminated. As shown in FIG. 7, the pig device 10 is pushed along the tube 100 in the direction of arrow A, leaving behind a coating formed of a thin layer of the coating material. The direction of the pig device 10 passing through the tube 100 is inconsequential to the implementation of the invention so long as the pig device 10 leads with the nose 14. To describe the action of the pig device 10, the following is provided. The coating material collects in front of the leading rib 18. This action is due to drag and frictional forces pushing the coating material into the pig device 10 as it travels through the tube 100. As the pig device 10 moves through the tube 100, the grooves 30 in the ribs 18, 20, 22, 24 let an amount of the coating material pass by and collect along the main body portion 12 of the pig device 10 before the flanged end 16. As the pig device 10 continues in the direction of arrow A, the flanged end 16 comes along and wipes the coating material to form the coating on the inner walls 102 of the tube 100.

Even distribution of the coating material is accomplished by the combination of the grooves 30 in the ribs 18, 20, 22, 24 controlling the initial amount of coating material being let into the region between the main body portion 12 and the action of the flanged end 16 wiping against the inner surface 102.

In the instance of the existence of the erosion element 104, the pig device 10 can be used to provide a coating patch. In short, the coating material is controlled by the ribs 18, 20, 22, 24 to the extent that a sufficient amount is available to fill the erosion element 104 in the form of a pit or imperfection as it exists in the tube 100 and as the pig device 10 comes across the pit or imperfection. As the pig device 10 passes over the erosion element 104, the coating material fills in any voids. Then as the flanged end 16 passes over the erosion element 104, any excess coating material is wiped away leaving sufficient material to form the coating patch, filling the erosion element 104. In areas on either side of the erosion element 104 the coating is applied to the inner surface 102.

The points of the teeth 28 of the ribs 18, 20, 22, 24 serve to center the pig device 10 within the tube 100, as discussed above. The grooves 30 permit the coating material to pass by the ribs 18, 20, 22, 24. Importantly, as the teeth 28 and grooves 30 of each rib are offset from the teeth 28 and grooves 30 of the rib immediately following it, as discussed previously, turbulence is created on the inner surface 102 of the tube 100. As will be readily appreciated, this turbulence on the inner surface 102 helps dislodge or displace air that may become trapped in an erosion element, providing for a smoother, more uniform and more complete coating and filling of the erosions elements 104 in the inner surface 102 of the tube 100. In particular, by agitating the air out of the erosion elements, bubbling of the coating material deposited into the erosion elements is prevented.

As also alluded to above, the ribs 18, 20, 22, 24 and the end flange 16 are preferably formed from a flexible material, allowing for some bending and flexing to accommodate variations in the inner diameter of the tube 100. The design of the teeth 28 of each rib also is beneficial during the injection molding process utilized to form the pig device 10, and allow two halves of the mold to separate to release the pig device 10.

In accordance with one example, a propulsion mechanism such as a compressed gas or liquid can be used in pushing the pig device 10 along the length of the tube 100. In the preferred embodiment, this propulsion mechanism is applied at the flanged end 16 of the pig device 10. As the propulsion mechanism is applied, the pig device 10 is motivated through the tube 100 to a far end. Depending on the particular tube configuration, the pig device 10 can continue, through a connector, to another tube, or alternatively exit the tube 100. One of ordinary skill in the art will appreciate that the propulsion mechanism used in motivating the pig device 10 along the length of the tube 100 may take numerous forms. Such propulsion mechanisms include, but are not limited to, compressed gases, liquids, and the like, a pressure differential such as a vacuum, as well as a rod-like structure that can be used to manually push the pig device 10 through the tube. Applicant has found the compressed propellant to be the most effective at this time; however other propelling devices or forces can be utilized to move the pig device 10 through the tube.

In addition, the pig device 10 can be pulled through the tube 100 by a line, such as a wire, string, tape, rod, and the like, made of any number of different materials, including synthetic, non-synthetic, metal, plastic, composite, woven, non-woven, etc. In an embodiment, the pig device 10 may be pulled through the tube via the aperture 27 in the nose 14. Accordingly, the present invention is not limited by the particular material or structure of the device utilized to pull the pig device 10 through the tube 100. Alternatively a negative pressure differential can be employed to pull the pig device 10 along the length of the tube 100.

The use of the pig device 10 provides a user with added control over the dimensions of the resulting coating. More specifically, the pig device 10, by varying such portions as the end flange 16, can be modified to specifically result in a desired coating having a predetermined and substantially consistent thickness and distribution. In particular, the dimensions and shape of the end flange 16, and of the main body portion 12, can be varied to control the distribution and amount of material being deposited on the inner surface 102.

The configuration of the pig device 10, with the wiping action of the end flange 16, enables substantially improved control over the coverage and thickness of the coating. In accordance with one embodiment of the present invention, coatings having a thickness on the order of less than 0.25 mils can be achieved using the pig device 10 of the present invention. This results in the ability to provide a coating that has a substantially reduced effect on heat transfer properties of the tube where the coating covers the inner surface in areas of otherwise good condition, while also repairing pits and other erosion elements 104. Thus, the overall effect of use of the pig device 10 of the present invention on a tube in otherwise good condition is to provide a coating of thickness much smaller than past processes, with minimal heat transfer effect, but improved durability and ability to repel corrosion and other fouling or deteriorating elements. The overall effect of use of the pig device 10 of the present invention on a tube having erosion elements 104 that are detracting from tube performance is to repair and renovate the tube to restore the tube to a much improved condition, delaying the need to shut down the system and replace the tube. Additionally, the present invention can be utilized in coating a tube 100 which does not suffer from erosion elements or fouling, wherein the resulting coating is of minimal thickness. Such a uniform coating using the present invention is beneficial in industrial applications where the material the existing tube is manufactured from is incompatible with the proposed fluid for use within the existing tube. In a refrigeration setting, for example, a common copper heat exchanger that is in working order can be coated using the present invention such that a thin coating is uniformly applied to all regions of the interior of the heat exchanger tubes. This uniform coating covers all exposed copper surfaces along the interior of the tube. Following such a coating, a refrigerant that is otherwise incompatible with copper tubing can now be used, as the interior of the heat exchanger tubes no longer have any regions of exposed copper. One skilled in the art will readily recognize that this is solely an illustrative example of a use of the present invention in providing an inner surface of a tube which is compatible with the intended working fluid contained by the tube. Such an example is clearly not exhaustive of the potential used of recoated tubes.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A pig device for use in the application of a coating material to a tube, comprising:

an elongated body portion having a front end and a rear end, said rear end having a flange that is circular in cross-section and has a continuous, peripheral edge;

a plurality of spaced annular flexible ribs circumscribing said body portion, said plurality of ribs being located intermediate said front end and said rear end of said body portion, being spaced from said front end and said rear end, and extending radially outward from said body portion for contacting the inside wall of said tube, said ribs being generally sprocket shaped and having a plurality of teeth angularly spaced from one another and defining a plurality of grooves therebetween allowing for a passage of the coating material;

wherein for at least one rib of said plurality of ribs, a thickness of at least one of said plurality of teeth of said rib decreases in a direction moving from a dedendum circle of said rib to an addendum circle of said rib, wherein said plurality of teeth of each rib of said plurality of ribs are integrally formed with each said rib, and wherein a diameter of said flange is greater than a diameter of each of said plurality of ribs.

2. The pig device of claim 1, wherein:

said plurality of ribs include at least three ribs include a first rib adjacent to said front end, a second rib spaced from said first rib and positioned behind said first rib towards said rear end, and a third rib spaced from said second rib and positioned behind said second rib towards said rear end;

wherein said grooves of said first rib are longitudinally aligned with said grooves of said third rib.

3. The pig device of claim 1, wherein the coating material passes by said plurality of ribs and collects along the elongated body portion between said plurality of spaced annular ribs and said flange.

4. The pig device of claim 1, wherein:

said flange is cone-shaped.

5. The pig device of claim 1, wherein:

said grooves of one of said plurality of ribs are longitudinally aligned with said grooves of another of said plurality of ribs.

6. A pig device for use in the application of a coating material to a tube, comprising:

an elongated body portion having a front end and a rear end, said rear end having a flange that is circular in cross-section and has a continuous, peripheral edge;

a plurality of spaced annular flexible ribs circumscribing said body portion, said plurality of ribs being located intermediate said front end and said rear end of said body portion, being spaced from said front end and said rear end, and extending radially outward from said body portion for contacting the inside wall of said tube, said ribs being generally sprocket shaped and having a plurality of teeth angularly spaced from one another and defining a plurality of grooves therebetween allowing for a passage of the coating material along said elongated body portion between said plurality of spaced annular ribs and said flange;

wherein for said at least one rib of said plurality of ribs, a thickness of at least one of said plurality of teeth of said rib decreases in a direction moving from a dedendum circle of said rib to an addendum circle of said rib, wherein said plurality of teeth of each rib of said plurality of ribs are integrally formed with each said rib, wherein a diameter of said flange is greater than a diameter of each of said plurality of ribs, and wherein each rib of said plurality of ribs, from a point of joining with said body portion to the addendum circle, has a substantially uniform thickness, measured in an axial direction of the body portion.

7. The pig device of claim 6, wherein:

said ribs include a first rib adjacent to said front end and a second rib spaced from said first rib and positioned behind said first rib towards said rear end;

wherein said teeth of said first rib are angularly offset relative to said teeth of said second rib.

8. The pig device of claim 6, wherein:

said teeth of said first rib are longitudinally aligned, in an axial direction, with said grooves of said second rib.

9. The pig device of claim 6, wherein:

said teeth of said first rib are angularly offset relative to said teeth of said second rib by a distance equal to one half of a pitch of said teeth.

* * * * *